United States Patent [19]

Keller

[11] 4,292,824

[45] Oct. 6, 1981

[54] DOUBLE SIDED TUMBLER CYLINDER FOR A SECURITY LOCK

[76] Inventor: Ernst Keller, Quertrasse 6, Richterswil, Switzerland, 8805

[21] Appl. No.: 34,558

[22] Filed: Apr. 30, 1979

[30] Foreign Application Priority Data

May 12, 1978 [CH] Switzerland ..... 5239/78

[51] Int. Cl.[3] ..... E05B 9/04

[52] U.S. Cl. ..... 70/373; 70/DIG. 60

[58] Field of Search ..... 70/373, 374, 417, DIG. 60

[56] References Cited

U.S. PATENT DOCUMENTS 1,433,363 10/1922 Freysinger ..... 70/373

1,854,563 4/1932 Shaw ..... 70/373

FOREIGN PATENT DOCUMENTS 202431 8/1923 United Kingdom ..... 70/373

*Primary Examiner*—Robert L. Wolfe

*Attorney, Agent, or Firm*—Browdy and Neimark

[57] ABSTRACT

A double pin tumbler cylinder for a security lock in which a pin tumbler rotates in a cylinder housing. The cylinder housing is composed of an axial stack of discs punched from a sheet of chrome-nickel steel. The individual discs are soldered or welded together to constitute a rigid element. The discs have a tang portion in which an opening is made so that the assembled stack defines a channel for receiving a bar of chrome-nickel steel for additional reinforcement of the cylinder. The bar has an enlarged central portion with a threaded bore for receiving a locking screw.

1 Claim, 3 Drawing Figures

DOUBLE SIDED TUMBLER CYLINDER FOR A SECURITY LOCK

FIELD OF THE INVENTION

The invention relates to security locks, especially of the pin tumbler type. More particularly, the invention relates to a pin tumbler cylinder which has provision for the insertion of a key from both sides.

BACKGROUND OF THE INVENTION AND PRIOR ART

Double pin tumbler cylinders of the type described above are known for example from U.S. Pat. No. 3,974,671. Described there is a cylinder housing in which the housing pins and their springs are located in separate chambers within the housing and in which the cylindrical housing is subdivided into, for example, a number of sintered, pressed parts for the purpose of reducing the cost of production and increasing the security against tampering.

It has been shown in practice however that the assembly of tumbler cylinders from separately produced parts represents great difficulty due to the variation of the dimensions of the individual parts, resulting in cylinder cores which tend to jam in the cylinder and which present excessive resistance to the insertion and removal of the keys.

OBJECT AND SUMMARY OF THE INVENTION

It is thus a principal object of the present invention to provide a tumbler cylinder of the above-described type which can be produced in relatively simple manner, and which presents high security against tampering and against forcible opening. These and other objects are attained according to the invention by providing a pin tumbler cylinder in which the cylinder housing is composed of discs that are assembled in the axial direction of the cylinder and are immovably attached to one another.

In a particularly advantageous feature of the invention, the individual discs which constitute the cylinder are punched out of chrome-nickel steel sheet and are then combined by hard soldering or welding. In this manner it is possible to produce cylinder housings of great strength and relatively low fabrication tolerances, i.e., parts which can be held within relatively tight dimensions.

The security of the cylinder according to the invention can be still further enhanced, especially with respect to the possibility of twisting the cylinder in the lock, by providing a space in the radially extending cylinder tang and inserting therein a barrier with an enlarged central portion having a threaded bore that receives a locking screw.

Further details of the invention will emerge from the description of a preferred exemplary embodiment and the illustration of the drawing.

DESCRIPTION OF THE PREFERRED EMBODIMENT

Figure 2:
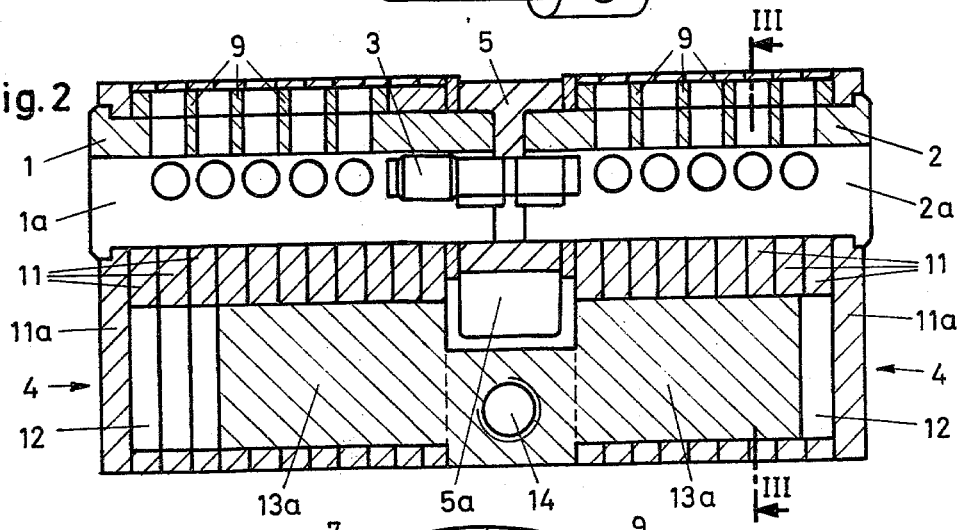
FIG. 2 is a longitudinal section through a double pin tumbler cylinder according to the invention, the pins and their springs being omitted.
Figure 3:
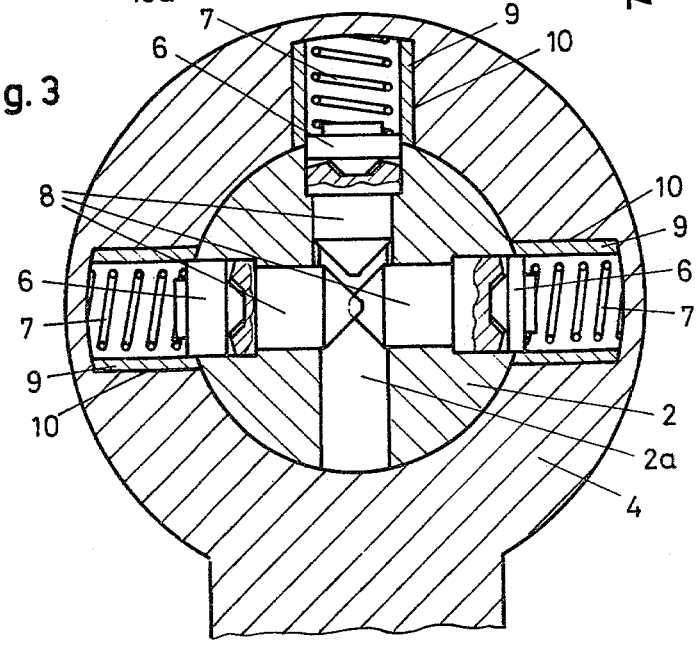
FIG. 3 is a section along the line III—III in FIG. 2 in enlarged scale.

The double pin tumbler lock cylinder according to the invention, which is shown in axial section in FIG. 2, includes a known cylinder housing 4 in which are inserted cylinder cores 1 and 2. The cylinder cores are coupled in known manner by a coupling 3. By inserting a key, not shown, into either key channel 1*a* or 2*a*, it is possible to rotate the cylinder cores 1, 2. This rotation causes a corotation of the ring 5 and a movement of the tab 5*a* which engages the bolt of the associated lock in which the pin tumbler cylinder is installed. When no key is present in the key channels 1*a*, 2*a*, the relative rotation of the cores 1, 2 with respect to the housing 4 is prevented by the housing pins 6 which are pushed into the core by springs 7 and which also displace the core pins 8 into the key channels 1*a*, 2*a* (See FIG. 3). This construction is generally known. It is also known to house the spring 7 and the housing pins 6 in separate chambers 9 which are inserted in axial slots in the cylinder housing 4 for the purpose of facilitating assembly of the cylinder.

Figure 1:
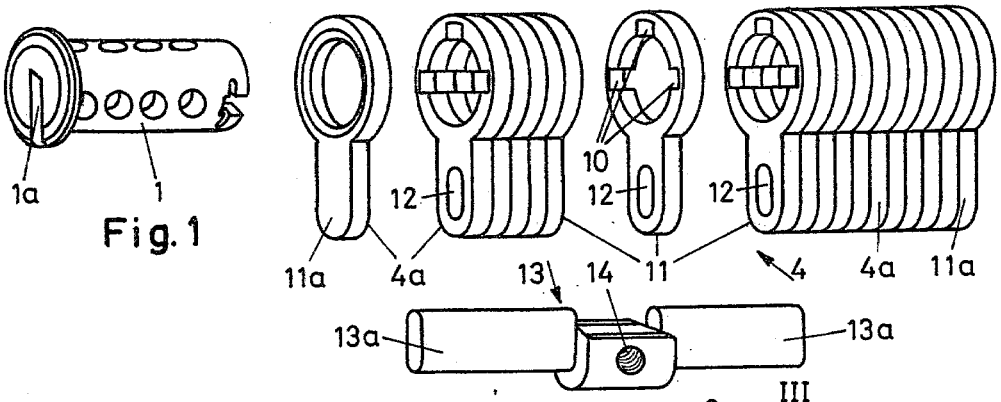
FIG. 1 is an exploded perspective view of a cylinder housing according to the invention.

In the known art, the cylinder housing was usually produced of one single piece, for example of brass. According to the invention, however, this cylinder housing is assembled from individually punched discs 11 consisting of chrome-nickel steel sheet, the individual discs 11 being joined to one another by welding or hard soldering. As is best seen in FIG. 1, all the discs 11 are identically constructed with the exception of the two discs 11*a* at the respective ends of the cylinder housing 4. These end discs do not have the slot 10 and also do not share the channel 12 in the tang of the cylinder.

As best seen in FIG. 2, the channel 12 contains the two parts 13*a* of the bar 13 whose central portion is provided with a threaded bore 14 which is engaged by a locking screw, not shown, that is inserted when the cylinder is mounted in the lock of a door, for example. The bar 13 is composed of three pieces of chrome-nickel steel which are welded or hard soldered together, and its presence results in a substantial increase of the strength of the cylinder housing.

The foregoing description relates to a preferred exemplary embodiment of the invention, within the scope of which variants thereof are possible.

I claim:

1. A pin tumbler cylinder for a security lock including a cylinder housing and rotatably disposed therein a cylinder core, said core having recesses for receiving individual chambers in each of which are disposed a locking pin and a pin spring and wherein said cylinder housing is composed of an axial stack of discs which are immovably joined, each of said discs having a tang portion, a plurality of said discs having an opening in said tang portion, said openings together constituting a channel for receiving a reinforcing bar, and a reinforcing bar having an enlarged central portion provided with a radial threaded bore for receiving a locking screw.

* * * * *